US006371758B1

(12) United States Patent
Kittelsen

(10) Patent No.: US 6,371,758 B1
(45) **Date of Patent: *Apr. 16, 2002**

(54) ONE-PIECE CUSTOMIZABLE DENTAL APPLIANCE

(75) Inventor: Jon D. Kittelsen, Fridley, MN (US)

(73) Assignee: Bite Tech, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/763,929

(22) Filed: Dec. 12, 1996

Related U.S. Application Data

(63) Continuation-in-part of application No. 08/689,253, filed on Aug. 5, 1996, now Pat. No. 5,836,761.

(51) Int. Cl.[7] ..... A61C 3/00; A61F 5/14

(52) U.S. Cl. ..... 433/6; 128/861

(58) Field of Search ..... 433/6, 34, 37, 433/41, 44, 45; 128/859, 861, 862

(56) References Cited

U.S. PATENT DOCUMENTS

| | | | | |
|---|---|---|---|---|
| 257,038 A | | 4/1882 | McMann | |
| 1,117,928 A | | 11/1914 | Thurmond | |
| 1,323,832 A | | 12/1919 | Chige | |
| 1,461,209 A | | 7/1923 | Bridges | |
| 1,470,888 A | | 10/1923 | Smedley | |
| 1,487,392 A | | 3/1924 | Lee | |
| 2,118,980 A | | 5/1938 | Montgomery et al. | |
| 2,257,709 A | | 9/1941 | Anderson | |
| 2,423,005 A | * | 6/1947 | Chaiken | 433/41 |
| 2,630,117 A | | 3/1953 | Coleman | |
| 2,643,652 A | | 6/1953 | Cathcart | |
| 2,659,366 A | | 11/1953 | Savarese | |
| 2,669,988 A | | 2/1954 | Carpenter | |
| 2,678,043 A | | 5/1954 | Stark | |
| 2,694,397 A | | 11/1954 | Herms | |
| 2,702,032 A | | 2/1955 | Freedland | |
| 2,708,931 A | | 5/1955 | Freedland | |
| 2,750,941 A | | 6/1956 | Cathcart | |
| 2,833,278 A | * | 5/1958 | Ross | 128/862 |
| 2,847,003 A | | 8/1958 | Helmer et al. | |
| 2,966,908 A | | 1/1961 | Cathcart et al. | |
| 3,016,052 A | | 1/1962 | Zubren | |
| 3,058,462 A | | 10/1962 | Greenblum | |
| 3,073,300 A | | 1/1963 | Berghash | |
| 3,082,765 A | | 3/1963 | Helmer | |
| 3,107,667 A | | 10/1963 | Moore | |
| 3,124,129 A | | 3/1964 | Grossberg | |

(List continued on next page.)

FOREIGN PATENT DOCUMENTS

| | | |
|---|---|---|
| CA | 1147583 | 6/1983 |
| DE | 480423 | 8/1929 |

OTHER PUBLICATIONS

Muscular Strength Correlated to Jaw Posture and the Temporomandibular Joint, Stephen D. Smith, D.M.D., NYS Dental Journal, vol. 44, No. 7, Aug.–Sep., 1978.

Reduction of Stress in the Chewing Mechanism—Part III, W.B. May, D.D.S., Basal Facts, vol. 3, No. 1, pp. 22–28.

*Primary Examiner*—Ralph A. Lewis
(74) *Attorney, Agent, or Firm*—Gerald E. Helget; Nelson R. Capes; Rider Bennett Egan & Arundel

(57) ABSTRACT

A one-piece customizable dental appliance for the mouth of an athlete is comprised of an occlusal posterior pad for each side of the posterior teeth engageable with the occlusal surfaces to space apart the teeth and to absorb shock and clenching stress. A band is provided connecting the posterior pads together within the mouth and out of the way of the tongue to maintain the position of the occlusal posterior pads within the mouth during use and to prevent loss of the pads such as by swallowing. Portions of the pads are scored so that they may be easily cut away to customize the appliance for smaller mouths.

18 Claims, 6 Drawing Sheets

U.S. PATENT DOCUMENTS 3,126,002 A 3/1964 Owens
3,203,417 A 8/1965 Helmer
3,207,153 A 9/1965 Goldstein
3,247,844 A 4/1966 Berghash
3,312,218 A 4/1967 Jacobs
3,319,626 A 5/1967 Lindsay
3,407,809 A 10/1968 Ross
3,411,501 A 11/1968 Greenberg
3,448,738 A 6/1969 Berghash
3,485,242 A 12/1969 Greenberg
3,505,995 A 4/1970 Greenberg
3,532,091 A 10/1970 Lerman
3,682,164 A 8/1972 Miller
3,768,465 A 10/1973 Helmer
3,864,832 A 2/1975 Carlson
3,924,638 A 12/1975 Mann
3,943,924 A 3/1976 Kallestad et al.
4,030,493 A 6/1977 Walters et al.
4,044,762 A 8/1977 Jacobs
4,114,614 A 9/1978 Kesling
4,185,817 A 1/1980 Peterson
4,211,008 A 7/1980 Lerman
4,330,272 A 5/1982 Bergersen
4,337,765 A 7/1982 Zimmerman
4,346,205 A 8/1982 Hiles
4,348,178 A 9/1982 Kurz
4,376,628 A 3/1983 Aardse
4,457,708 A 7/1984 Dufour
4,519,386 A 5/1985 Sullivan
4,568,280 A 2/1986 Ahlin
4,671,766 A 6/1987 Norton
4,672,959 A 6/1987 May et al.
4,727,867 A 3/1988 Knoderer
4,755,139 A * 7/1988 Abbatte et al. ..... 433/6
4,763,791 A 8/1988 Halverson et al.
4,765,324 A 8/1988 Lake, Jr.
4,791,941 A 12/1988 Schaefer
4,793,803 A 12/1988 Martz
4,799,500 A 1/1989 Newbury
4,810,192 A 3/1989 Williams
4,827,578 A 5/1989 Heckerman et al.
4,848,365 A 7/1989 Guarlotti et al.
4,867,147 A 9/1989 Davis
4,889,533 A 12/1989 Beecher
4,924,557 A 5/1990 Heckerman et al.
4,976,618 A * 12/1990 Anderson ..... 433/6
4,977,905 A 12/1990 Kittelsen et al.
5,031,638 A 7/1991 Castaldi
5,076,785 A 12/1991 Tsai
5,082,007 A 1/1992 Adell
5,117,816 A 6/1992 Shapiro et al.
D328,494 S 8/1992 Schwendeman
5,152,301 A 10/1992 Kittelsen et al.
5,165,424 A 11/1992 Silverman
5,194,004 A 3/1993 Bergersen
5,234,005 A 8/1993 Kittensen et al.
5,235,991 A 8/1993 Minneman
5,259,762 A 11/1993 Farrell
D343,928 S 2/1994 Kittelsen
5,293,880 A 3/1994 Levitt
5,297,960 A * 3/1994 Burns ..... 433/41
5,299,936 A 4/1994 Ueno
5,313,960 A 5/1994 Tomasi
5,316,474 A 5/1994 Robertson
5,320,114 A 6/1994 Kittelsen et al.
5,323,787 A 6/1994 Pratt
5,336,086 A 8/1994 Simmen et al.
5,339,832 A 8/1994 Kittelsen et al.
5,353,810 A 10/1994 Kittelsen et al.
5,365,946 A 11/1994 McMillan
5,385,155 A 1/1995 Kittelsen et al.
5,386,821 A * 2/1995 Poterack ..... 128/861
D356,188 S 3/1995 Kittelsen
5,401,234 A * 3/1995 Libin ..... 128/861
5,447,168 A 9/1995 Bancroft
5,460,527 A 10/1995 Kittelsen
5,513,656 A * 5/1996 Boyd, Sr. ..... 433/6
5,566,684 A 10/1996 Wagner
5,584,687 A * 12/1996 Sullivan et al. ..... 433/6

* cited by examiner

ONE-PIECE CUSTOMIZABLE DENTAL APPLIANCE

This application is a continuation-in-part of co-owned patent application Ser. No. 08/689,253, filed on Aug. 5, 1996 for an ADJUSTABLE CUSTOMIZED DENTAL APPLIANCE.

BACKGROUND OF THE INVENTION

This invention relates generally to a one-piece customizable dental appliance for use by athletes and, more particularly, to an appliance that spaces apart the teeth to absorb shock and clenching stress, to space apart the anterior teeth of the lower and upper jaws to facilitate breathing and speech, to lessen condylar pressure, force and impact upon the cartiage and temporomandibular joints, the arteries and the nerves, and to further increase body muscular strength and endurance.

Almost all athletes such as body builders, weight lifters, baseball batters, golfers, football players, hockey players and bowlers clench their teeth during exertion which results in hundreds of pounds of compressed force exerted from the lower jaw onto the upper jaw. This clenching force is unevenly transmitted through the jaw structure into the connective tissues and muscles of the lower jaw and further into the neck and back. This can result in headaches, muscle spasms, damage to teeth, injury to the temporomandibular joint, and pain in the jaw. Furthermore, clenching the teeth makes breathing more difficult during physical exercise and endurance when breathing is most important.

The glenoid fossa located directly ventral to the external auditory meatus is the hollow receptacle for the mandibular condyle or condylar process.

The articulation of the condyle in the glenoid fossa is a pure hinge activity around a horizontal axis through the initial 4–10 mm of the opening of the human mouth. After this initial pure hinging function, the continued opening of the mouth becomes a transitory action of the condyle moving forward or ventrally in the glenoid fossa as the continued opening of the mouth is accomplished by the mandible moving in a forward or ventral position. This action of the temporo-mandibular joint (TMJ) is unique in mammals, and is the start of aberrations in the human TMJ.

If through trauma, pathology, or habit, the articular surface of the condyle has been altered in its ideal anatomic form, and/or the meniscus is damaged or perforated, an arthritic condition can result, which damages the articular surfaces and associated cartilageanous tissues which lubricate and cushion these two bones, the fossa and the condyle.

When the individual attempts to utilize the supportive musculature and skeletal components of the body during strength utilization, or in a stress situation, the muscles of mastication contract in response to this increased stress, and clench the dentition or teeth to such a degree as to compress the structures of the TMJ.

The position of the major muscles of mastication, the masseter and the temporals, pull the mandible up and dorsally or back, so that the condyle is driven into the glenoid fossa to a greater degree than in any other situation, and against these altered structures.

In an absolutely ideal anatomic situation where the structures of the TMJ have not been altered, this clenching will have minimal effect on the utilization of the human body's skeletal muscles.

Since the negative effects of changes in the TMJ are not known without extensive radiographic, magnetic resonance investigation, and/or surgical analysis, a great percentage of the population will experience a limiting effect by the autonomic nervous system, that system which regulates the stress evaluation by the brain, to limit the clenching action of the jaws.

By placing an appliance of a non-yielding material between the posterior teeth, which will open the mouth from 1 to 5 mm by preventing the mandible from being pulled into the condylar-fossa pressure position, the clenching action of the jaws will not over-burden the TMJ or drive the condyle into the glenoid fossa, until this over-burden causes the brain to direct the skeletal muscles to limit their utilization.

Furthermore, there is a suture line in the dome of all human glenoid fossae which may be the major component limiting the result of the clenching in the TMJ. As certain individuals clench in increased strength and/or stress activities, this pressure on the glenoid fossa dome can cause edema to result. If an individual partaking in a physical activity sustains a traumatic insult to the TMJ, and an edematous condition results, the balance centers of the skull can be affected and the strength potential will be reduced unless the clenching activity is controlled to prevent the compression of the condyle in the fossa.

There is a condition called bruxism which is an unknown causation, idiopathic movement of the mandible, resulting in grinding of the teeth. This condition is particularly troublesome during sleep, because during sleep the muscles of the jaw contract more than while the person is awake and this can cause physical and physiological damage to the masticating apparatus (bone, teeth, muscles, and soft tissues). This damage may cause the capsular system around the TMJ to shrink so that the person cannot open the jaws. An appliance may be inserted in the mouth to prevent bruxism, but where the condition has progressed to the point where the jaws can only be slightly opened, the appliance must be insertable into the mouth through this narrow opening.

It has also been found that a dental appliance which allows the wearer to clench the teeth can contribute to the alleviation of stress. Such a device may also be a rehabilitation of recovery aid after general surgery by reducing levels of bodily stress. Finally, a clenching device may have use as a birthing aid for women.

There is a need for a simple one-piece customizable dental appliance for the mouth of an athlete which will absorb shock and clenching stress otherwise transferred from the connective tissues, the muscles and lower jaw to the upper jaw, neck and back, will space apart the anterior teeth of the lower jaw from the anterior teeth of the upper jaw to facilitate breathing and speech, and will lessen condylar pressure, force and impact upon the cartilage, and temporomandibular joints, arteries and the nerves.

Also, it is desirable that the dental appliance can be manufactured in one size and easily adjusted and customized to the mouths of almost all wearers, from a child to an adult.

SUMMARY OF THE INVENTION

A one-piece customizable dental appliance for the mouth of an athlete is comprised of an occlusal posterior pad for each side of the posterior teeth engageable with the occlusal surfaces to space apart the teeth and to absorb shock and clenching stress. A band is provided connecting the posterior pads together within the mouth and out of the way of the tongue to maintain the position of the occlusal posterior pads within the mouth during use and to prevent loss of the pads such as by swallowing. Portions of the pads are scored so that they may be easily cut away to customize the appliance for smaller mouths.

A principal object and advantage of the present invention is that the one-piece appliance is simple to mold and protects the teeth, jaws, gums, connective tissues, back, head and muscles from teeth clenching forces typically exerted during athletic activity.

Another principal object and advantage of the present invention is that it is adjustable or customizable to fit the mouth of almost all wearers while at the same time being securely retained by the anterior teeth and posterior teeth.

Another object and advantage of the present invention is that it facilitates breathing and speech during strenuous physical activity such as in power lifting or body building.

Another object and advantage of the present invention is that the appliance places the lower jaw in the power position moving the condyle downwardly and forwardly away from the nerves and arteries within the fossae or socket to increase body muscular strength, greater endurance, and improved performance by the appliance user.

Other objects and advantages will become obvious with the reading of the following specification and appended claims with a review of the Figures.

DETAILED DESCRIPTION OF THE PREFERRED EMBODIMENTS

Figure 1:
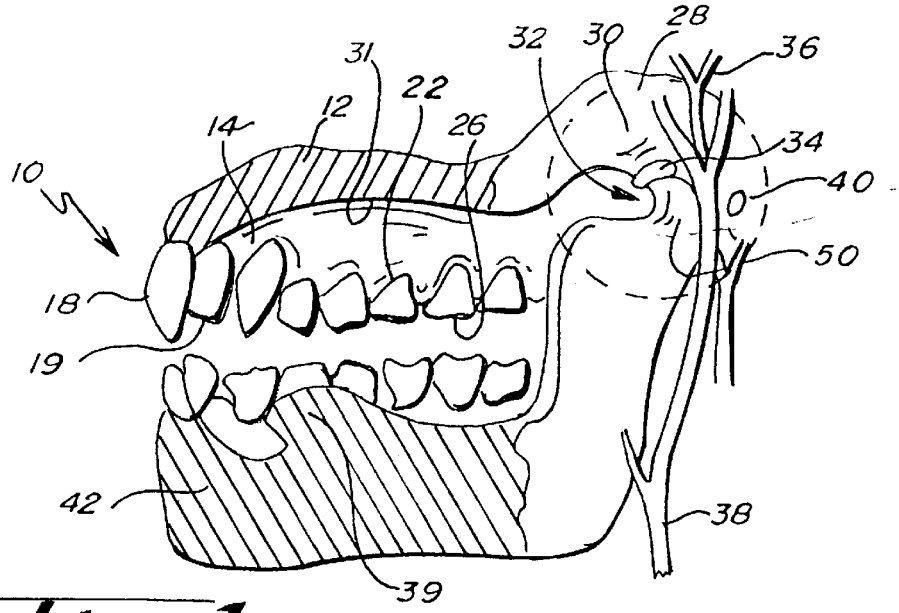
FIG. 1 is a maxillary mandibular buccal or partial side elevational view of the jaws and temporomandibular joint of a user of a dental appliance of the present invention.
Figure 1A:
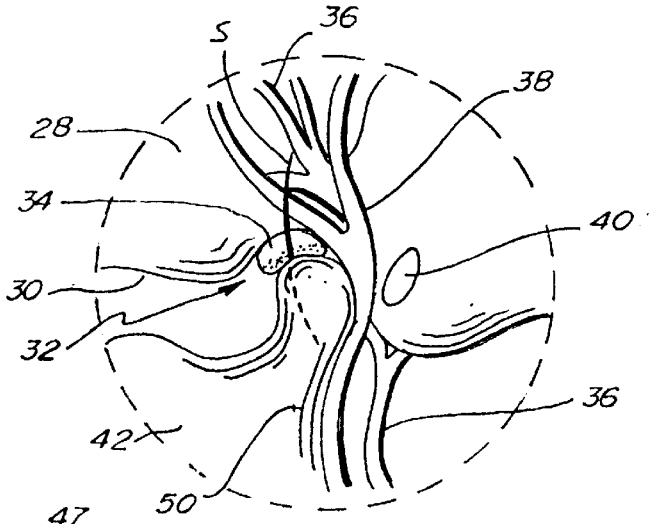
FIG. 1A is an enlarged view of the circled temporomandibular joint portion of FIG. 1.
Figure 1B:
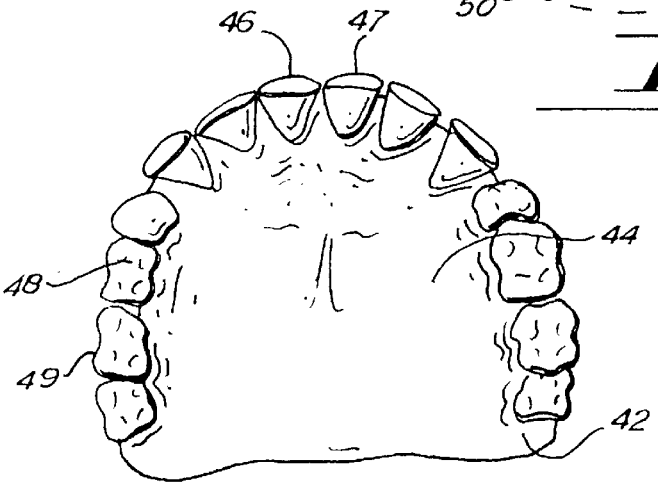
FIG. 1B is a top view of the lower jaw, partially broken away.

To understand the structural features and benefits of one embodiment of the dental appliance 70 of the present invention, some anatomy will first be described. Referring to FIGS. 1 and 1A, the user or athlete has a mouth 10 generally comprised of a rigid upper jaw 12 and a movable lower jaw 42 which are movably connected at the temporomandibular joint (TMJ) 32 and 50.

More specifically, the rigid upper jaw 12 has gum tissue 14 within mouth 10. Gum tissue 14, as well as the bone thereunder, supports anterior teeth (incisors and canines) 18 which have incisal or biting surfaces 19. The gum tissues 14 and the bone thereunder also support posterior teeth (molars and bicuspids) 22 which have cusps or biting surfaces 26.

Referring to one side of the human head, the temporal bone 28 is located upwardly and rearwardly of the upper jaw 12 and is in the range of 1/16 to 1/32 inch thick. The articular eminence 30 forms the beginning of the glenoid fossa 32 or the socket of the temporomandibular joint 32 and 50. Rearwardly and posteriorly to the articular eminence 30 is located cartilage or meniscus 34. Through the temporomandibular joint 32 and 50 pass the auriculo-temporalis nerve 36 and the supra-temporo artery 38. Posteriorly to this structure is located the inner ear 40. Within the mouth is located tongue 39 and the roof or hard palate 31 which terminates rearwardly into the soft palate.

The movable jaw or mandible 42 supports a bone covered by gum tissue 44 which further supports anterior teeth (incisors and canines) 46 with incisal or biting surfaces 47 and posterior teeth (molars and bicuspids) 48 with occlusal biting surfaces 49. The condyle 50 of the lower jaw 42 forms the ball of the temporomandibular joint 32 and 50. The anatomical structure is the same for both sides of the head.

Repeated impacts, collisions, blows, stress or forces exerted on the movable lower jaw 42 result in excessive wearing forces upon the condyle 50 and the cartilage or meniscus 34—typically resulting in deterioration or slippage of the cartilage 34. Thereafter, the lower jaw 42 may be subject to irregular movement, loss of comfortable range of movement, and clicking of the joint 32 and 50.

The auriculo-temporalis nerve 36 relates to both sensory and motor activity of the body. Any impingement or pinching of this nerve 36 can result in causing the brain to cause cessation of clenching activity, resulting in the loss of power. The supra-temporal artery 38 is important in that it provides blood circulation to the head. Impingement, pinching, rupture or blockage of this artery 38 will result in possible loss of consciousness and reduced physical ability and endurance due to the restriction of blood flow to the brain. Thus, it is extremely important to assure that the condyle 50 does not put pressure upon the bony structure around the auriculo-temporalis nerve 36 or the supra-temporal artery 38.

It is also important to note that glenoid fossa of the temporal bone 28 is not too thick. Medical science has known that a sharp shock, stress, or concussive force applied to the lower jaw 42 possibly could result in the condyle 50 protruding through the glenoid fossa of the temporal bone 28, thereby causing death. This incident rarely, but sometimes, occurs with respect to boxing athletes.

Referring to FIGS. 2 through 13, the adjustable customized dental appliance embodiment 70 may generally be seen.

The appliance 70 has posterior occlusal pads 72 each including a base 74 for receiving the posterior teeth 22 of the lower jaw 42 as further explained below. The base 74 has an inner surface 80 facing the lower jaw posterior teeth 48. Extending downwardly from base 74 is the labial wall 82 and lingual wall 84. Connecting the respective labial walls 84 of both pads 72 is an adjustable band 86 which is shaped as to lie out of the way of the tongue 39. Enclosed by the base 74, labial wall 82, and lingual wall 84 is a channel 87.

Figure 5:
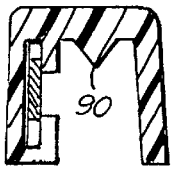
FIG. 5 is a cross section along the lines 5—5 of FIG. 4.

Optionally, the posterior occlusal pads 72 may have raised portions 90 on the inner surface 80 of the base 74 (FIG. 5). The occlusal pads 72 and raised portions 90 should suitably be made of a thermoplastic rubber such as that marketed under the trademark Kraton® which is marketed by GLS Plastics of 740B Industrial Drive, Gary, Ill. 60013. This thermoplastic rubber is unique in that it is injection-moldable, FDA approved, and readily adheres with copolymers of ethylene and vinyl acetate. Furthermore, the thermoplastic rubber has a melting or softening point significantly higher than that of EVA which will facilitate fitting of the dental appliance 70 to the user or athlete's mouth 10. Furthermore, the thermoplastic rubber, unlike copolymers of ethylene and vinyl acetate, exhibits high resilience, low compression, shape maintenance and shock absorption, attenuation and dissipation. Virtually all rubbers exhibit these physical characteristics which may be utilized for the posterior pads 72 and raised portions 90.

The raised portions 90 are arranged suitably to be in the bicuspid or molar regions of the teeth 46 and 49. The raised portions 90 may preferably take the form of cones but may also be spheres, columns, or knobs.

The posterior pads 72, and optionally the raised portions 90, cause the mandible or lower jaw 42 to slide forwardly and slightly downwardly while fitting the dental appliance 70. Also, the condyles 50 are moved downwardly and away from the fossae or sockets 32 without the need for exotic devices and/or measurements, articulation, etc. Furthermore, optional raised portions 90 assure proper fitting of the appliance 70, as will be further discussed below.

As is also to be appreciated that the occlusal pads 72 space apart the anterior teeth 18 and 46 while the adjustable band 86 is clear of the tongue 39 which will readily permit the wearer to easily breathe in power fashion as well as convey the ability to speak clearly.

Figure 4:
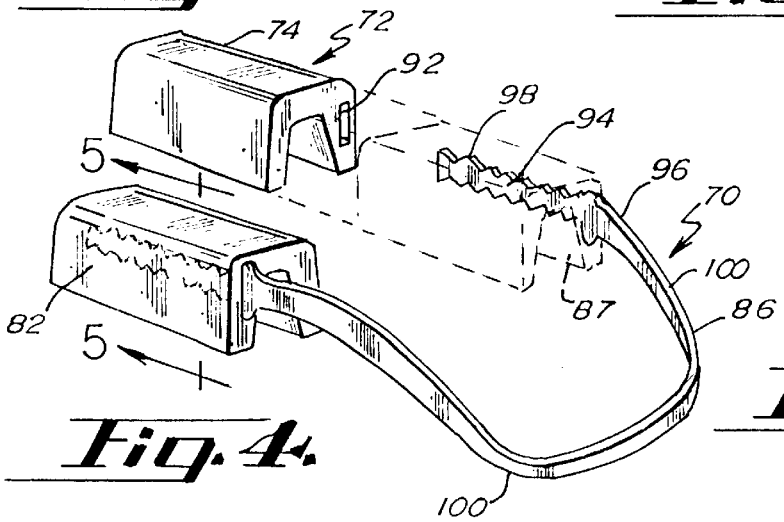
FIG. 4 is a perspective view of the dental appliance of the present invention, partially broken away to show internal structure.
Figure 6:
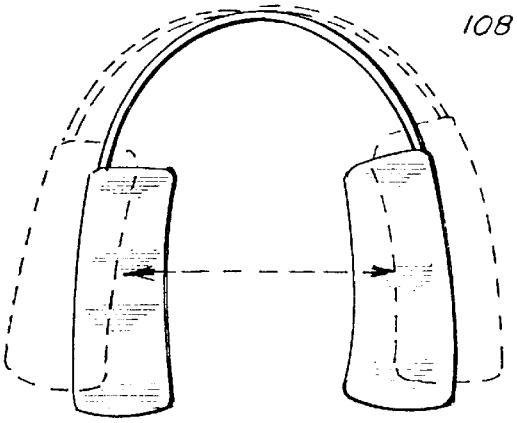
FIG. 6 is a top plan view of one embodiment of the dental appliance of the present invention with alternative positioning shown in phantom.

The adjustable band 86 is preferably adjustable from side to side, as shown in FIG. 6, to adapt to the lateral spacing between the two sets of posterior teeth 48. The adjustable band 86 is also preferably adjustable fore and aft, as shown in FIG. 4, to adjust to the location of the posterior teeth 48 within the mouth. In this way, the appliance 10 may be manufactured in a single size which should fit the majority of mouth sizes.

The adjustable band 86 is preferably made of a malleable metal which may be bent, as shown in FIG. 6, to adjust the lateral separation between the posterior pads 72 and to maintain the lateral separation after adjustment. Preferably, the malleable metal is titanium, which is light and non-corroding. Alternatively, the malleable metal could be a gold alloy or stainless steel.

As can best be seen in FIG. 4, the appliance 10 preferably includes a slot 92 in the labial wall 82 of the posterior pads 72 and an insert 94 on the posterior ends 96 of the adjustable band 86. The insert 94 slidingly and frictionally engages the slot 92 to allow fore and aft adjustment of the posterior pads, as shown in FIG. 4. Preferably, the insert 94 has a plurality of serrations 98 which frictionally engage the slot 92 allowing fore and aft adjustment and maintenance of the adjustment after adjustment is complete.

Figure 7:
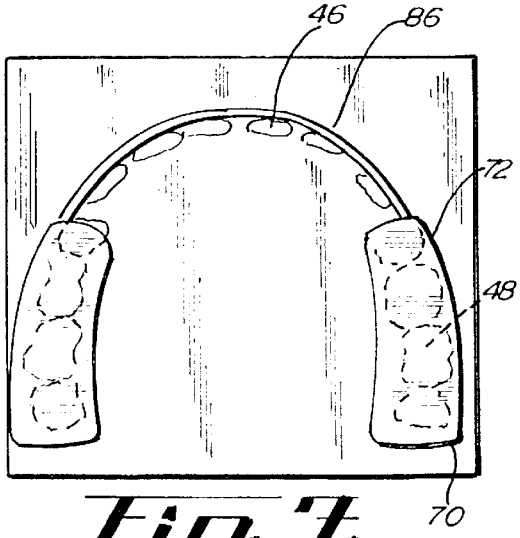
FIG. 7 is a top plan view of a sizing medium and dentition imprint with one embodiment of the dental appliance of the present invention overlaid thereon.
Figure 8:
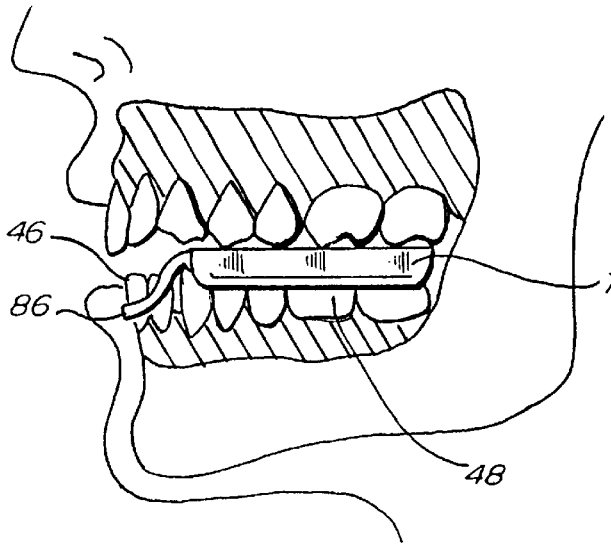
FIG. 8 is a side elevational view of the jaws of the user with structure broken away to show one embodiment of the dental appliance of the present invention being fitted to the mouth.

As can best be seen in FIGS. 7 and 8, the adjustable band 86 preferably engages the anterior surfaces of the anterior teeth 46 of the lower jaw 42. In the preferred embodiment, the adjustable band 86 is substantially U-shaped and the arms 100 of the adjustable band 86 curve downward from the posterior pads 72 to engage the anterior surfaces of the anterior teeth 86. This keeps the arms 100 out of the way of the tongue.

Figure 2:
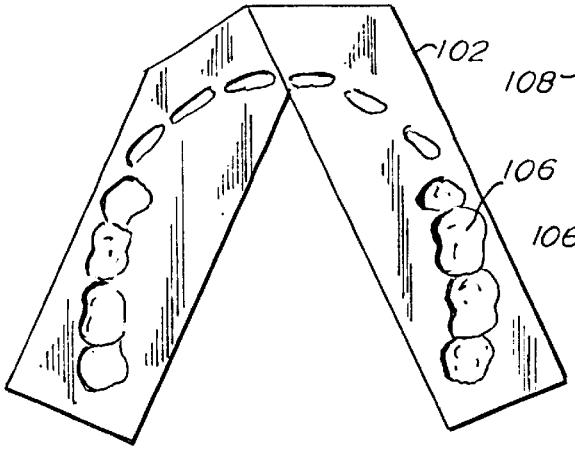
FIG. 2 is a top view of a sizing strip with a dentition imprint.
Figure 3:
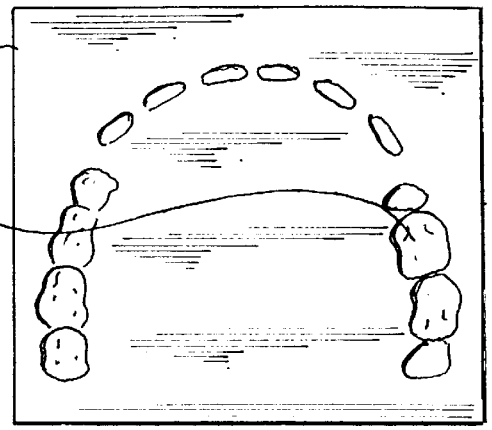
FIG. 3 is a top view of an alternative sizing medium with a dentition imprint.

To fit the appliance 70 to the wearer, an impression of the lower teeth may first be taken, as shown in FIG. 2, on a sizing strip 102, as has been described in U.S. Pat. No. 5,385,155, hereby incorporated by reference. This forms a dentition imprint 106. Alternatively, the dentition imprint 106 may be taken on any suitable medium 108, such as wax, cardboard, tin foil, styrofoam, or paper, as shown in FIG. 3.

After the dental imprint 106 is taken, the appliance 70 is laid on top of the dental imprint 106 and the lateral separation between the posterior pads 72 is adjusted, as has been earlier described and as shown in FIG. 7.

Next, the appliance 70 is inserted into the mouth and the fore and aft adjustment of the posterior pads 72 is made to conform to the position of the lower posterior teeth 48 in the mouth, as has been earlier described and shown in FIG. 4. As the adjustment is made, the adjustable band 86 is placed over the anterior teeth 46. Also, the end cap 114 of the posterior pads 72 is placed over the rearmost of the lower teeth 48. The appliance 70 is then held securely in place by the band 86 over the anterior teeth and the end cap 114 over the posterior teeth.

It will be seen that at this point, the appliance 70 has been accurately sized to the mouth of the wearer, as shown in FIG. 8. However, the posterior pads 72 will not yet be accurately fitted to the posterior teeth 48 because the channel 87 is of a single size and the posterior teeth 48 have occlusal surfaces 49 which vary from person to person.

Figure 12:
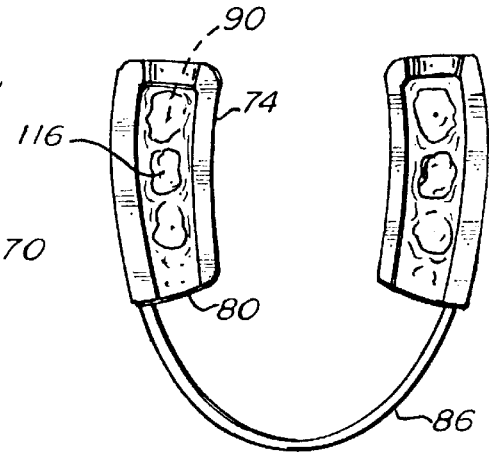
FIG. 12 is a bottom plan view of the dental appliance of the present invention with dentition imprints from the lower teeth.
Figure 8A:
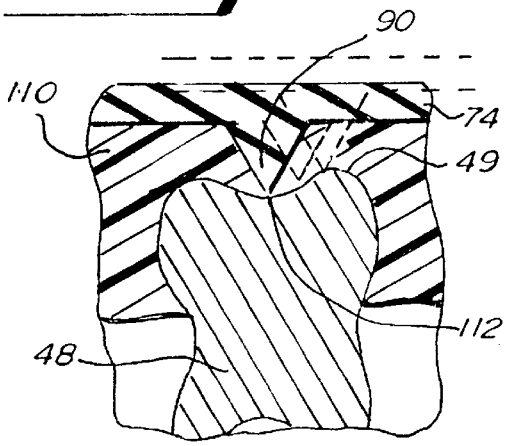
FIG. 8A is a close-up view of one embodiment of the dental appliance of the present invention being fitted to the lower teeth, with alternative positioning shown in phantom.
Figure 11:
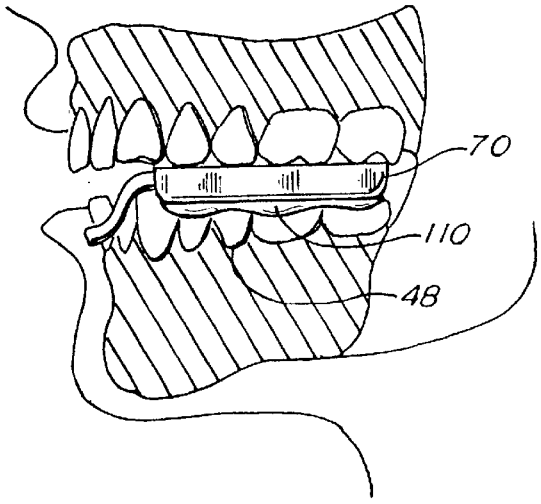
FIG. 11 is a side elevational view of the jaws of the user with structure broken away to show the dental appliance of the present invention being finally fitted to the mouth.
Figure 9:
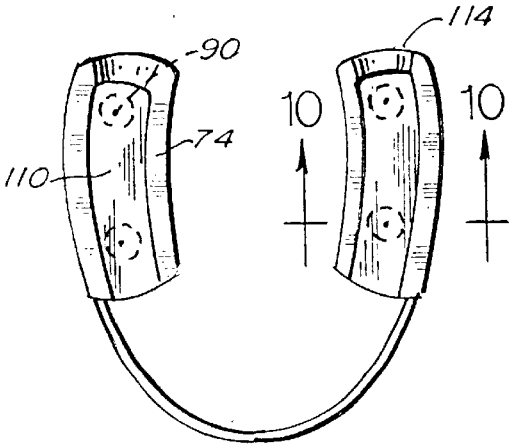
FIG. 9 is a bottom plan view of the dental appliance of the present invention with moldable material inserted in the channel.
Figure 10:
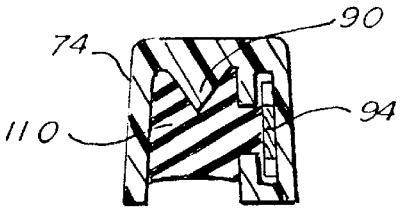
FIG. 10 is a cross section along the lines 10—10 of FIG. 9.
Figure 13:
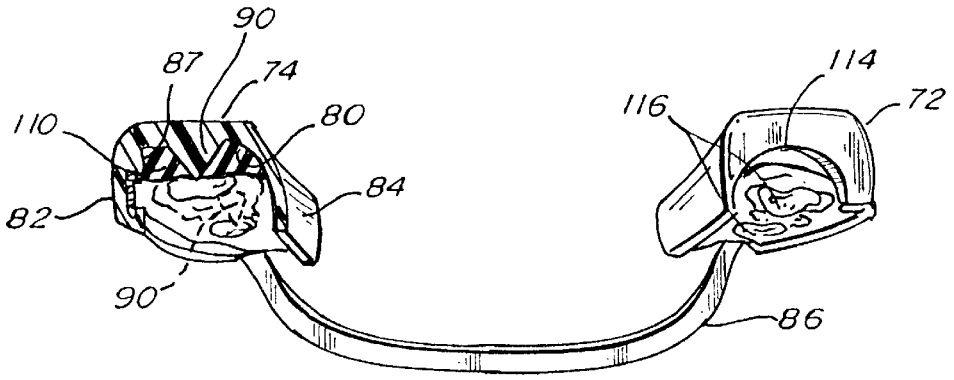
FIG. 13 is a rear perspective view of the dental appliance of the present invention.
Figure 14:
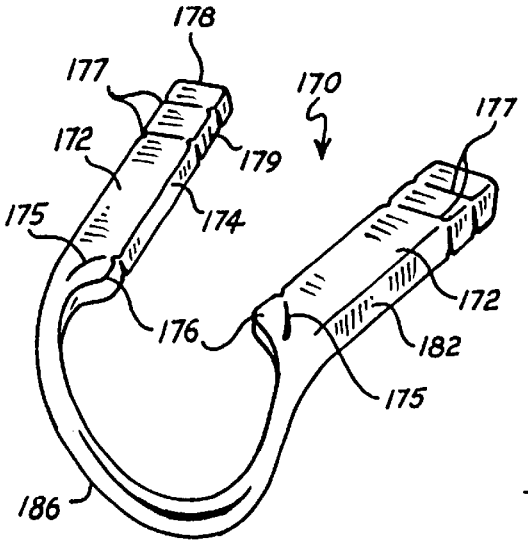
FIG. 14 is a perspective view of the one-piece customizable dental appliance of the present invention.
Figure 18:
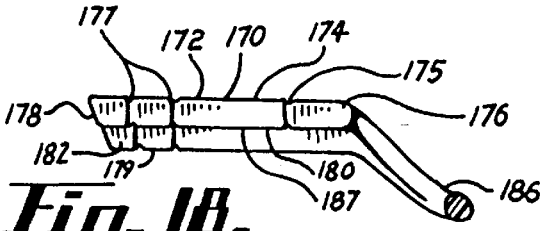
FIG. 18 is a cross sectional view taken along lines 18—18 of FIG. 15.
Figure 17:
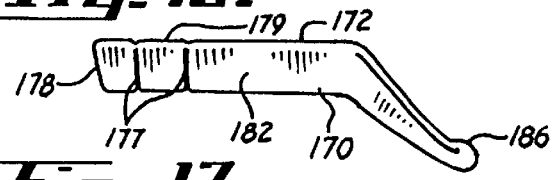
FIG. 17 is a right side elevational view of the one-piece dental appliance.
Figure 15:
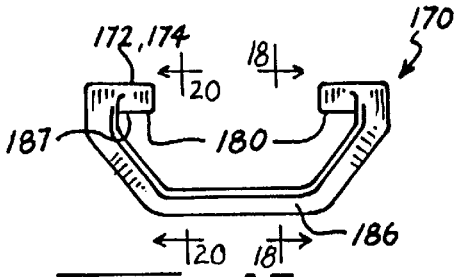
FIG. 15 is a front elevational view of the one-piece dental appliance.
Figure 20:
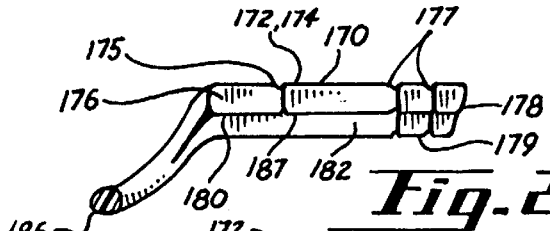
FIG. 20 is a cross sectional view taken along lines 20—20 of FIG. 15.
Figure 19:
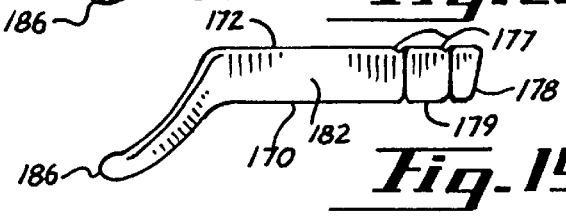
FIG. 19 is a left side elevational view of the one-piece dental appliance.
Figure 16:
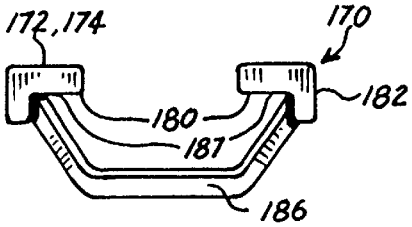
FIG. 16 is a rear elevational view of the one-piece dental appliance.
Figure 21:
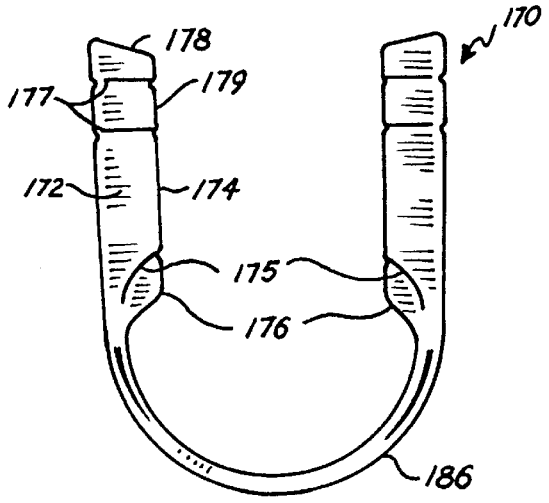
FIG. 21 is a top plan view of the one-piece dental appliance.
Figure 22:
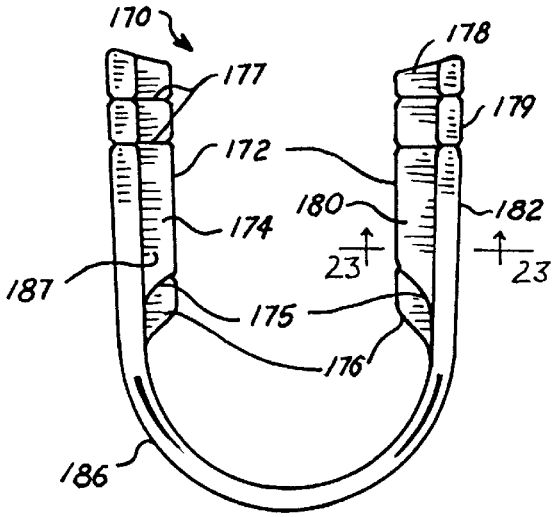
FIG. 22 is a bottom plan view of the one-piece dental appliance.

To complete the fitting of the appliance 70, the appliance 70 is removed from the mouth and a moldable material 110 is inserted in the channel 87, as shown in FIG. 9. Alternatively, the appliance 70 may be manufactured with moldable material already inserted in the channel 87. The appliance 70 is reinserted into the mouth and the wearer bites down, causing the teeth of the upper and lower jaw to occlude about the appliance 70. The lower teeth 48 will optionally contact the raised portions 90 preventing the lower teeth 48 from contacting the base 74 and from causing excess of the material 110 from being forced out of the channel 87. As can be seen in FIG. 8A, the raised portions 90 also cooperate with the moldable material 110 to allow occlusal registration of the lower teeth 48 and the base 74. That is, the raised portions 90 slide along the occlusal surfaces 49 until the raised portions 90 are in a valley 112 on the occlusal surfaces. As can be seen in FIG. 11, a small amount of the moldable material 110 is forced out of the channel 87 and lies along the buccal surfaces of the lower teeth 48. FIG. 12 shows the result of this step. The moldable material 110 will have a dentition impression 116 of the lower teeth and will now be customized to the mouth.

Finally, the appliance 70 is removed from the mouth and the moldable material is hardened by an appropriate method producing a completely fitted appliance.

The moldable material may be a light-curing resin which is soft when in the dark but becomes hardened when exposed to light. Such a light-curing resin may preferably consist essentially of methyl methacrylate, chlorosulfonated polyethylene, fluoridated methacrylate, methacrylic acid, and photo initiators. A suitable light-curing resin is available under the name Spectra Tray from Ivoclar AG, Bendererstrasse 2, FL-9494 Schaan/Liechtenstein.

Alternatively, the moldable material may be a low-temperature, moldable, thermal plastic such as ethylene vinyl acetate (EVA). It has been found that EVA is a commercially available compound and approved for oral use by the Food and Drug Administration. Another possible moldable material may be the Hydroplastic™ material from TAK Systems, P. O. Box 939, East Wareham, Mass. 02538.

To fit the appliance 70, the appliance 70 may momentarily be submersed suitably in boiling water. Thereafter, the appliance 70 is immediately placed onto the posterior teeth 48. The wearer then applies suction between the lower jaw 42 and the appliance 70 while packing the appliance 70 with the hands along the cheeks adjacent the posterior teeth 48.

By this action, the user of the appliance 70 will have correct jaw posture for athletic participation once fitting has been completed. The posterior teeth 48 of the lower jaw 42 will properly index upon the inner surfaces 80 of the occlusal pads 72. Should the raised portions 90 optionally be embedded within the pads 72, they will absorb, attenuate and dissipate shock and stress forces such as created by clenching. Furthermore, the user will experience increased endurance, performance, and muscular freedom due to the power positioning and posture of the TMJ joints 32 and 50.

Referring to FIGS. 14 through 25, the one-piece customizable dental appliance 170 may generally be seen.

The appliance 170 has posterior occlusal pads 172 each including a base 174 having a forward or anterior score line 175 forming a removable forward portion 176. Base 174 also has two rearward or posterior score or serration lines 177 forming first and second respectively removable rearward portions 178 and 179. The base 174 has an inner surface 180 and an outwardly downwardly extending or depending labial wall 182. Pads 172 are connected by forwardly and downwardly extending band 186. Inner surface 180 and labial wall 182 form a channel 187 for receiving the posterior teeth 48.

The one-piece customizable dental appliance 170 may be made of a variety of thermoplastic or elastomeric moldable compounds. For instance, ethylene vinyl acetate (EVA) is a good thermoplastic FDA approved. Neoprene may also work well. Elastomeric rubbers (such as Kraton®) produced by GLS Plastic of 740B Industrial Drive, Gary, Ill. 60013, also is an FDA approved elastomer with significant durability which works well with the appliance 170 as previously described.

Figure 23:
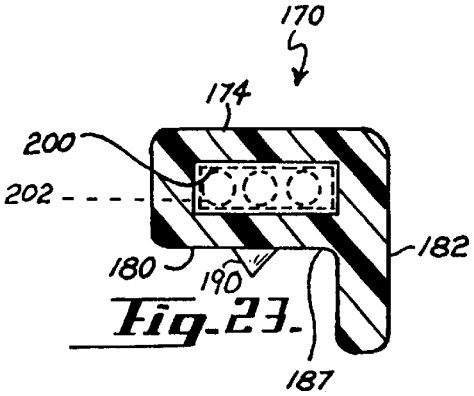
FIG. 23 is a cross sectional view taken along lines 23—23 of FIG. 21 showing a shock absorbing chamber which alternately may be employed in the one-piece design.
Figure 24:
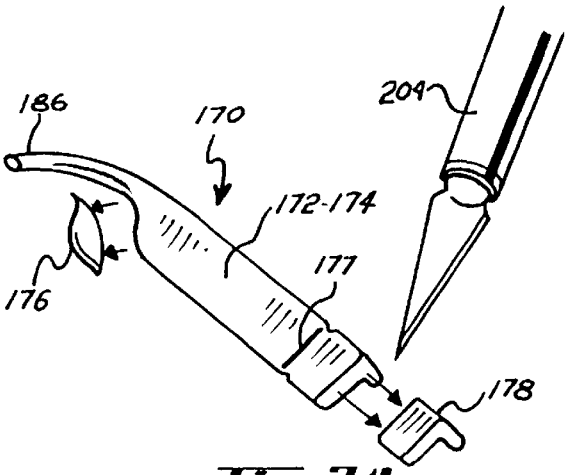
FIG. 24 is a broken away figure of the one-piece dental appliance with two of the three cut away portions being partially removed.

As FIG. 23 reveals, base 174 may have shock or cushioning chambers 200 which suitably may be filled with cushioning media 202 which may include air, gel, neoprene or Kraton materials. A raised portion 190, similar to 90, may also be included.

Figure 25:
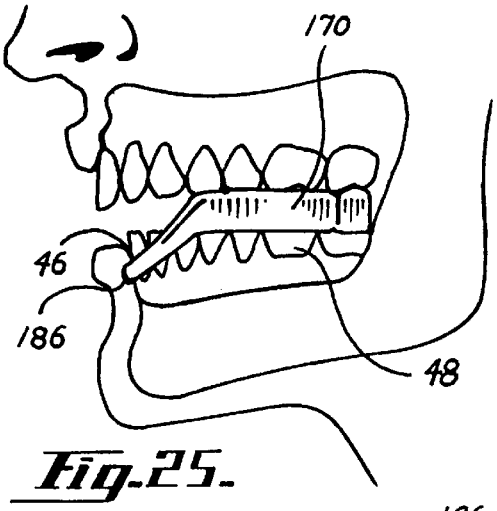
FIG. 25 is a side elevational view of the jaws of the user with structure broken away to show the one-piece embodiment of the appliance being fitted to the mouth.

In fitting the one-piece customizable dental appliance 170, the wearer may use the sizing strip 102 or dentition imprint 108 as previously described. Next, the appliance 170 may be placed over the teeth imprint 106 to determine if any of the removable portions 176, 178 or 179 should be removed. Alternatively, the user may simply place the appliance 170 in his or her mouth and feel the appliance 170 for a proper fit with fingers and tongue. Thereafter, a knife 204 (FIG. 24) may be utilized to follow score or serration lines 175 or 176 to remove unnecessary portions 176, 178 or 179 to assure a proper fit as shown in FIG. 25.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed:

1. A one-piece customizable dental appliance for the mouth of an athlete having an upper jaw with anterior teeth, posterior teeth with occlusal surfaces, a palate and fossae with cartilage forming sockets, a tongue, and a movable lower jaw with anterior teeth, posterior teeth with occlusal surfaces and condyles movably fitted with connective tissue and muscles within the sockets forming the temporomandibular joints through which the auriculotemporalis nerves and supra-temporal arteries pass, the one-piece appliance comprising:

a pair of occlusal posterior pads for extending along the posterior teeth and having a forward portion and a rearward portion engageable with the occlusal surfaces of the posterior teeth of the lower jaw to space apart the teeth, each pad having a base with an inner surface facing the posterior teeth and a labial wall extending downward from the base and the base and labial wall together forming a channel to receive the posterior teeth, the base having a removable portion to customize to the mouth size, the pad adapted to absorb shock and clenching stress otherwise transferred from the connective tissues, the muscles and the lower jaw to the upper jaw, neck and back, to space apart the anterior teeth of the lower jaw from the anterior teeth of the upper jaw to facilitate breathing and speech, and to lessen condylar pressure, force and impact upon the cartilage, and temporomandibular joints, the arteries and nerves; and a band connected to the posterior pads and having posterior ends connecting the posterior pads together within the mouth extending forwardly and downwardly along the lower jaw anterior teeth and shaped as to lie out of the way of the tongue to maintain the positions of the occlusal posterior pads within the mouth and to prevent loss of the pads such as by swallowing.

2. The appliance of claim 1, wherein the removable portion is formed by a score line along the pad forward portion.

3. The appliance of claim 1 wherein the removable portion is formed by a score line along the pad rearward portion.

4. The appliance of claim 3, further comprising a second removable portion which is formed by a second score line along the pad rearward portion.

5. The appliance of claim 1, wherein the removable portion is formed by a score line along the pad forward portion and further comprising a second removable portion formed by a second score line along the pad rearward portion.

6. The appliance of claim 1, wherein the appliance is made of a thermoplastic.

7. The appliance of claim 6, wherein the thermoplastic is ethylene vinyl acetate.

8. The appliance of claim 1, wherein the appliance is made of an elastomeric rubber.

9. The appliance of claim 1, wherein the posterior pads further comprise a plurality of raised portions on the inner surface of the base.

10. The appliance of claim 9, wherein the raised portions are cone-shaped portions designed to position the posterior pads properly and to maintain a fixed space between the upper and lower jaws.

11. The appliance of claim 1, further comprising cushioning and shock dissipation chambers in the base.

12. The appliance of claim 11, further comprising a cushioning media in the chambers.

13. A one-piece customizable dental appliance for the mouth of an athlete having an upper jaw with anterior teeth, posterior teeth with occlusal surfaces, a palate and fossae with cartilage forming sockets, a tongue, and a movable lower jaw with anterior teeth, posterior teeth with occlusal surfaces and condyles movably fitted with connective tissue and muscles within the sockets forming the temporomandibular joints through which the auriculo-temporalis nerves and supra-temporal arteries pass, the one-piece appliance comprising:

a pair of posterior pads for extending along the posterior teeth and having a forward portion and a rearward portion engageable with the occlusal surfaces of the posterior teeth to space apart the teeth, each pad having a base with an inner surface facing the posterior teeth and a labial wall extending downward from the base and the base and labial wall together forming a channel to receive the posterior teeth, the base having a removable portion to customize to the mouth size, the pad adapted to absorb shock and clenching stress otherwise transferred from the connective tissues, the muscles and the lower jaw to the upper jaw, neck and back, to space apart the anterior teeth of the lower jaw from the anterior teeth of the upper jaw to facilitate breathing and speech, and to lessen condylar pressure, force and impact upon the cartilage, and temporomandibular joints, the arteries and nerves wherein the removable portion is formed by a score line along the pad forward portion; and a band connected to the posterior pads and having posterior ends connecting the posterior pads together within the mouth extending forwardly and downwardly along the lower jaw anterior teeth and shaped as to lie out of the way of the tongue to maintain the positions of the occlusal posterior pads within the mouth and to prevent loss of the pads such as by swallowing.

14. The appliance of claim 13, further comprising a second removable portion which is formed by a second score line along the pad rearward portion.

15. The appliance of claim 13, wherein the appliance is made of a thermoplastic.

16. The appliance of claim 15, wherein the thermoplastic is ethylene vinyl acetate.

17. The appliance of claim 13, wherein the appliance is made of an elastomeric rubber.

18. The appliance of claim 13, further comprising cushioning and shock dissipation chambers in the base.

* * * * *